US008978396B2

(12) United States Patent
Ellis et al.

(10) Patent No.: US 8,978,396 B2
(45) Date of Patent: Mar. 17, 2015

(54) VENT ICE PREVENTION METHOD

(75) Inventors: Bruce M. Ellis, Houston, TX (US); Huy Minh Pham, Houston, TX (US)

(73) Assignee: L'Air Liquide Societe, Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 93 days.

(21) Appl. No.: 13/530,263

(22) Filed: Jun. 22, 2012

(65) Prior Publication Data

US 2013/0340983 A1 Dec. 26, 2013

(51) Int. Cl.

| | |
|---|---|
| ***F25D 21/00*** | (2006.01) |
| ***F25D 21/12*** | (2006.01) |
| ***F28D 7/10*** | (2006.01) |
| ***F28F 13/00*** | (2006.01) |

(52) U.S. Cl.
CPC .. *F28D 7/10* (2013.01); *F28F 13/00* (2013.01)
USPC ..... 62/80; 62/81; 62/82; 62/272

(58) Field of Classification Search
CPC ..... F25D 21/04; F25D 21/06; F25D 21/12; F25D 21/065; F25B 47/022; F25B 47/006
USPC ..... 62/82, 275, 277, 282, 80, 81, 90, 122, 62/52.1, 373, 534, 74; 165/155; 239/8–10, 239/128, 132, 132.1, 418, 423–424
See application file for complete search history.

(56) References Cited

U.S. PATENT DOCUMENTS

| | | | | |
|---|---|---|---|---|
| 5,989,647 | A * | 11/1999 | Remy et al. | 427/446 |
| 6,649,062 | B1 * | 11/2003 | Petty | 210/649 |
| 7,228,715 | B2 * | 6/2007 | Brugerolle et al. | 62/643 |
| 2009/0205363 | A1 * | 8/2009 | de Strulle | 62/533 |
| 2010/0275620 | A1 * | 11/2010 | Zurecki et al. | 62/80 |
| 2012/0151961 | A1 * | 6/2012 | Ha et al. | 62/615 |

* cited by examiner

*Primary Examiner* — Frantz Jules
*Assistant Examiner* — Steve Tanenbaum
(74) *Attorney, Agent, or Firm* — Justin K. Murray

(57) ABSTRACT

An improved vent ice prevention method including introducing a cold vent stream into a first conduit, wherein at least a portion of the first conduit is concentric with a second conduit, thereby producing an annular region, introducing a hot vent stream into a third conduit, and wherein the third conduit is in fluid connection with the annular region, thereby preventing the first conduit or the second conduit from forming ice. The cold vent stream is a cold compressor seal vent stream. The hot vent stream is a warm compressor seal vent stream.

27 Claims, 2 Drawing Sheets

VENT ICE PREVENTION METHOD

BACKGROUND

Ice buildup on cold compressor seal gas discharge vents is a problem in some cryogenic plants. The function of vent lines can be defeated by the formation of ice (from condensed moisture) in the vent line. This can also be a safety issue, if a large piece of ice should fall from an elevated vent stack. A need exists in the industry for a simple and economical solution to this icing problem.

SUMMARY

An improved vent ice prevention method including introducing a cold vent stream into a first conduit, wherein at least a portion of the first conduit is concentric with a second conduit, thereby producing an annular region, introducing a hot vent stream into a third conduit, wherein the third conduit is in fluid connection with the annular region, thereby preventing the first conduit from forming condensation or ice. The cold vent stream is a cold compressor seal vent stream. The hot vent stream is a warm compressor seal vent stream.

DESCRIPTION OF PREFERRED EMBODIMENTS

Figure 1:
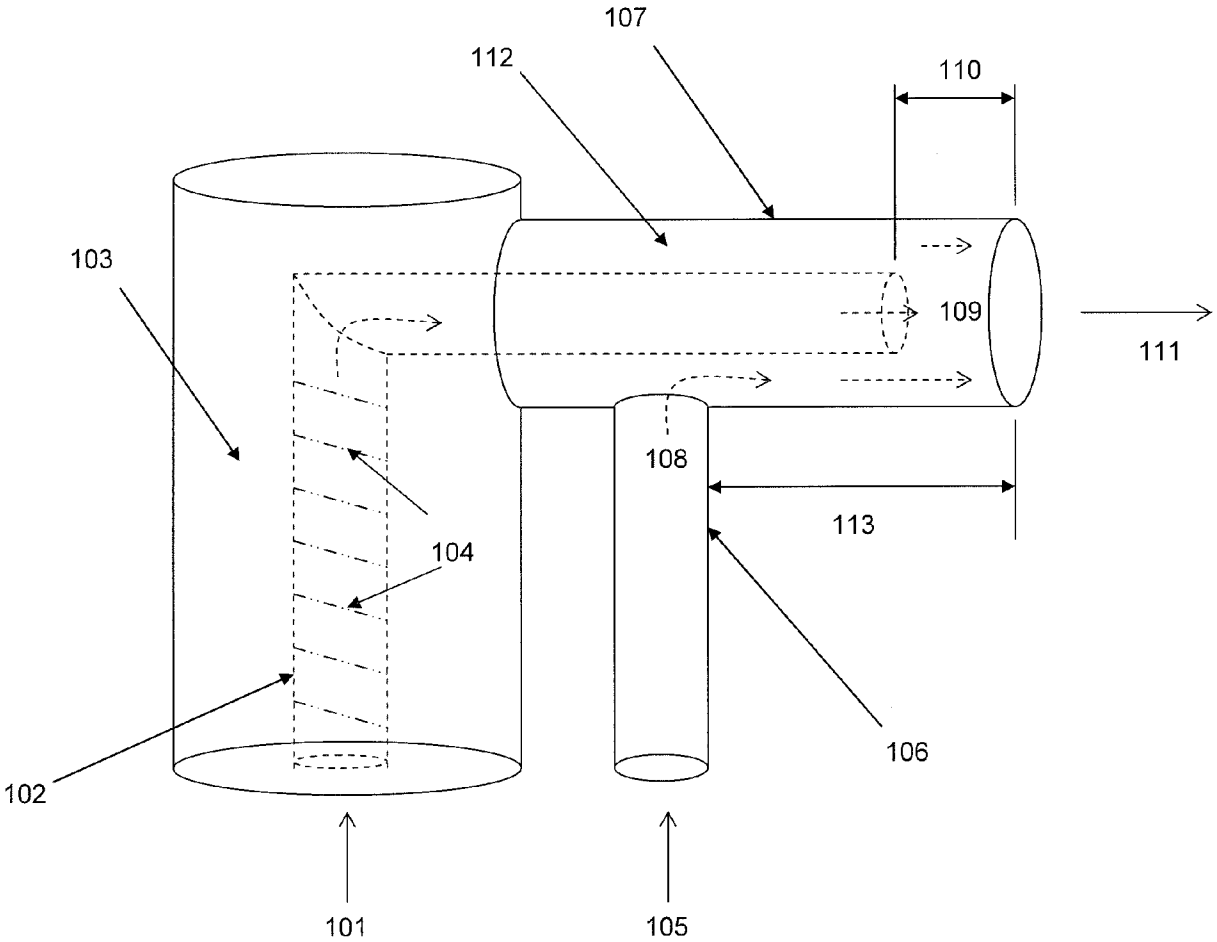
FIG. 1 illustrates one embodiment of the present invention.
Figure 2:
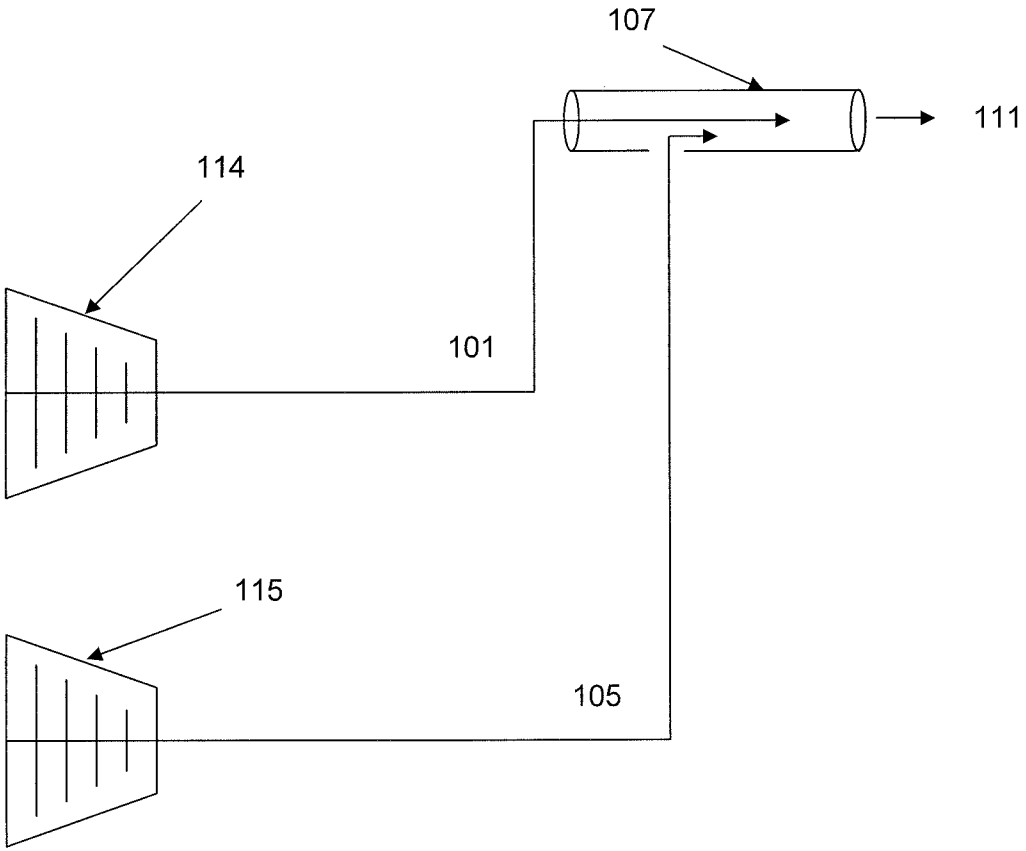
FIG. 2 illustrates another embodiment of the present invention.

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

As used herein, the term "cold compressor" means a device for raising the pressure of a vapor in which both the inlet and discharge streams are below the freezing point of water.

As used herein, the term "warm compressor" means a device for raising the pressure of a vapor in which both the inlet and discharge streams are above the freezing point of water.

By inserting the cold compressor discharge pipe inside a larger pipe, that is discharging the warm compressor seal gas, the warm gas prevents the ice formation. In the interest of clarity, element numbers are consistent between both figures. Turning now to FIG. 1, a cold vent stream 101 and a hot vent stream 105 are provided. Cold vent stream 101 a may be the seal vent stream from a cold compressor 114. Cold vent stream 101 may be air or nitrogen. Hot vent stream 105 may be the seal vent stream from a warm compressor 115. Hot vent stream 105 may be air, nitrogen, instrument air, or any other available warm dry vapor stream.

Cold vent stream 101 may be directed through a first conduit 102. At least part of first conduit 102 may be heat traced 104, thermally insulated 103, or both. At least part of first conduit 102 is concentric with a second conduit 107, thereby producing an annular region 112. Hot vent stream 105 may be directed through a third conduit 106, which intersects with second conduit 107. This allows hot vent stream 108 to flow through annular region 112 and thereby warming at least part of the exterior of first conduit 102 to a temperature above which icing will not occur. Cold vent stream 104 then combines with warm vent stream 108 to produce combined warm vent stream 109, which may be expelled into the atmosphere.

As the temperature difference between the cold vent stream 101 and the hot vent stream 105 increases, the hot vent stream 105 blankets first conduit 102 and acts as an insulator, preventing condensate to form. This prevents condensate and ice to form in the first place, thus making the de-icing of the second conduit 107 a less critical mechanism.

Combined warm vent stream 109 may have a mean temperature greater than 32 F. The exit of the first conduit 102 may be recessed from the exit of the second conduit 107. The exit of the first conduit 102 may be recessed from the exit of the second conduit 107 by at least twice the outside diameter of the second conduit 107. The exit of the first conduit 102 may be recessed from the exit of the second conduit 107 by at least 5 inches. The exit of the first conduit 102 may be flush with the exit of the second conduit 107.

What is claimed is:

1. An improved vent ice prevention method comprising the steps of:

introducing a cold vent stream into a first conduit, wherein at least a portion of said first conduit is concentric with a second conduit, thereby producing an annular region;

introducing a hot vent stream into a third conduit, wherein said third conduit is in fluid connection with said annular region; and expelling the cold vent stream and the warm vent stream to the atmosphere at a direction that is substantially along the axis of the first conduit thereby preventing said first conduit from forming condensation and/or ice at an exit of said first conduit while the hot vent stream is flowing through said annular region.

2. The improved vent ice prevention method of claim 1, wherein said cold vent stream is a cold compressor seal vent stream.

3. The improved vent ice prevention method of claim 2, wherein said cold compressor seal vent stream comprises air.

4. The improved vent ice prevention method of claim 2, wherein said cold compressor seal vent stream comprises nitrogen.

5. The improved vent ice prevention method of claim 1, wherein said hot vent stream is a warm compressor seal vent stream.

6. The improved vent ice prevention method of claim 5, wherein said warm compressor seal vent stream comprises air.

7. The improved vent ice prevention method of claim 5, wherein said warm compressor seal vent stream comprises nitrogen.

8. The improved vent ice prevention method of claim 1, wherein the exit of said first conduit is flush with the exit of said second conduit.

9. The improved vent ice prevention method of claim 1, wherein the exit of said first conduit is recessed from the exit of said second conduit.

10. The improved vent ice prevention method of claim 9, wherein the exit of said first conduit is recessed from the exit of said second conduit by at least twice the outside diameter of the second conduit.

11. The improved vent ice prevention method of claim 9, wherein the exit of said first conduit is recessed from the exit of said second conduit by at least 5 inches.

12. The improved vent ice prevention method of claim 1, wherein at least a portion of said cold vent stream is thermally insulated.

13. The improved vent ice prevention method of claim 1, wherein at least a portion of said cold vent stream is heat traced.

14. The improved vent ice prevention method of claim 1, further comprising the step of displacing moist air near an exit of the first conduit by the hot vent stream exiting the second conduit.

15. The improved vent ice prevention method of claim 1, wherein the second conduit is configured to direct the flow of the hot vent stream along the axis of the first conduit.

16. The improved vent ice prevention method of claim 1, further comprising the step of expelling the cold vent stream and the warm stream to the atmosphere at substantially the same location.

17. A method for reducing ice formation of a cryogenic vent, the method comprising the steps of:

introducing a cold vent stream into a first conduit, wherein a second conduit surrounds at least a portion of the first conduit thereby creating a region between the second conduit and the first conduit, wherein the first conduit has an inlet and an outlet, wherein the second conduit has an inlet and an outlet;

expelling the cold vent stream to the atmosphere at a direction that is substantially along the axis of the first conduit; and displacing moist air from the outlet of the first conduit by feeding a dry purge stream into the region between the second conduit and the first conduit through a third conduit, wherein the first conduit and the second conduit are configured to expel the warm vent stream to the atmosphere at a direction that is substantially along the axis of the first conduit, thereby preventing said first conduit from forming condensation and/or ice at the outlet of the first conduit.

18. The improved vent ice prevention method of claim 17, wherein said cold vent stream is a cold compressor seal vent stream.

19. An improved vent ice prevention apparatus comprising;

a first conduit configured to receive a cold vent stream originating from a cold compressor seal, the first conduit having an inlet and an outlet;

a second conduit surrounding at least a portion of the first conduit thereby creating a region between the second conduit and the first conduit, the second conduit having an inlet and an outlet; and a third conduit in fluid communication with the region between the second conduit and the first conduit, wherein the third conduit is configured to receive a dry purge stream and introduce the dry purge stream to the region between the second conduit and the first conduit and displace moist air from the outlet of the first conduit, thereby preventing condensation and/or ice formation at the outlet of the first conduit, wherein the first conduit and the second conduit are configured to expel the cold vent stream and the warm vent stream to the atmosphere at a direction that is substantially along the axis of the first conduit.

20. The improved vent ice prevention apparatus of claim 19, wherein the second conduit is configured to direct a flow of the dry purge stream along the axis of the first conduit.

21. The improved vent ice prevention method of claim 1, wherein the annular region has an absence of internal structure.

22. The improved vent ice prevention method of claim 1, wherein the annular region comprises an absence of a porous media.

23. The improved vent ice prevention method of claim 1, wherein the cold vent stream does not experience a substantial pressure drop upon exiting the first conduit.

24. The improved vent ice prevention method of claim 1, wherein the first conduit comprises an absence of a nozzle at its exit.

25. The improved vent ice prevention method of claim 1, wherein the first conduit is shaped such that the first conduit has a substantially constant cross sectional area, such that the fluid velocity within the first conduit is unaffected by the cross sectional area of the first conduit.

26. The improved vent ice prevention method of claim 1, wherein the flow velocity of the cold vent stream is substantially constant throughout the first conduit.

27. The improved vent ice prevention method of claim 1, further comprising the step of expelling the cold vent stream and the warm vent stream to the atmosphere at substantially the same location.

* * * * *